US005651654A

United States Patent [19]

Christenson

[11] Patent Number: 5,651,654

[45] Date of Patent: Jul. 29, 1997

[54] TILTING BIN HANDLER

[75] Inventor: Ronald E. Christenson, Parsons, Tenn.

[73] Assignee: McNeilus Truck and Manufacturing, Inc., Dodge Center, Minn.

[21] Appl. No.: 728,671

[22] Filed: Oct. 10, 1996

Related U.S. Application Data

[63] Continuation of Ser. No. 411,494, Mar. 28, 1995, abandoned.

[51] Int. Cl.[6] ..... B65F 3/04

[52] U.S. Cl. ..... 414/408; 414/420

[58] Field of Search ..... 414/303, 743, 414/406–409, 419–421, 486, 487, 736–738, 917

[56] References Cited

U.S. PATENT DOCUMENTS

| | | | |
|---|---|---|---|
| 3,286,860 | 11/1966 | Naab | 414/303 |
| 3,630,389 | 12/1971 | Schmidt et al. | 414/743 X |
| 3,804,277 | 4/1974 | Brown et al. | 414/303 |
| 3,894,642 | 7/1975 | Shive | 414/303 |
| 3,910,434 | 10/1975 | Ebeling et al. | 414/408 |
| 3,944,092 | 3/1976 | Ebeling et al. | 414/409 |
| 4,042,137 | 8/1977 | Hughes et al. | 414/421 X |
| 4,057,156 | 11/1977 | Thompson et al. | 414/420 X |
| 4,090,626 | 5/1978 | Ebeling et al. | 414/407 |
| 4,227,849 | 10/1980 | Worthington | 414/420 X |
| 4,305,693 | 12/1981 | Naab | 414/408 |
| 4,365,922 | 12/1982 | Borders | 414/406 |
| 4,422,814 | 12/1983 | Borders | 414/303 |
| 4,427,333 | 1/1984 | Ebeling | 414/409 |
| 4,479,751 | 10/1984 | Wyman et al. | 414/406 |
| 4,575,300 | 3/1986 | George | 414/406 |
| 4,580,940 | 4/1986 | Sheaves | 414/406 |
| 4,613,271 | 9/1986 | Naab | 414/408 X |
| 4,687,405 | 8/1987 | Olney | 414/408 |
| 4,715,767 | 12/1987 | Edelhoff et al. | 414/408 |
| 4,722,658 | 2/1988 | Würtz et al. | 414/408 |
| 4,726,726 | 2/1988 | Dossena et al. | 414/408 |
| 4,741,658 | 5/1988 | Zelinka et al. | 414/406 |
| 4,844,682 | 7/1989 | Edelhoff | 414/408 |
| 4,868,796 | 9/1989 | Ahrens et al. | 367/96 |
| 4,889,462 | 12/1989 | Naab et al. | 414/408 |
| 4,911,600 | 3/1990 | Zelinka et al. | 414/408 |
| 4,936,732 | 6/1990 | Naab et al. | 414/408 |
| 4,943,201 | 7/1990 | Billon | 414/408 |
| 4,966,514 | 10/1990 | Knapp | 414/408 |
| 4,983,092 | 1/1991 | Richards | 414/408 |
| 4,986,074 | 1/1991 | Hahmann et al. | 414/408 X |
| 5,002,450 | 3/1991 | Naab | 414/408 |
| 5,024,573 | 6/1991 | Redding et al. | 414/408 |

(List continued on next page.)

FOREIGN PATENT DOCUMENTS

| | | | |
|---|---|---|---|
| 6023190 | 2/1991 | Australia . | |
| 4192193 | 5/1994 | Australia . | |
| 0312900 | 4/1989 | European Pat. Off. . | |
| 11559 | 1/1977 | Japan | 414/917 |
| 1073086 | 2/1984 | U.S.S.R. | 414/917 |
| 1548030 | 3/1990 | U.S.S.R. | 414/917 |
| 2165814 | 4/1986 | United Kingdom | 414/406 |
| 9105721 | 5/1991 | WIPO . | |
| 22747 | 10/1994 | WIPO | 414/408 |

*Primary Examiner*—David A. Bucci
*Attorney, Agent, or Firm*—Haugen and Nikolai, P.A.

[57] ABSTRACT

The disclosure describes container handlers having a swivel mount pivotally attached to a handler base that pivots between a lowered and a raised position. A handle engaging flange secured to the swivel mount engages a container of interest as the swivel mount is raised. In one embodiment, a corresponding rim gripping flange attached to the base holds the container rim between the flanges in the raised position and active suction cups carried by the swivel mount also engage and hold the container during unloading operations. In another embodiment, a second handle engaging flange is pivotally attached to the swivel mount for pivoting between a retracted and a handle engaging position. The second flange engages a second spaced parallel handle before the container is tilted for unloading. The base of each embodiment may be connected to any lifting device, such as an articulated multiple-member support arm or boom connected to a refuse truck.

11 Claims, 14 Drawing Sheets

U.S. PATENT DOCUMENTS

| | | | |
|---|---|---|---|
| 5,026,241 | 6/1991 | Wyman | 414/303 |
| 5,033,930 | 7/1991 | Kraus | 414/408 |
| 5,044,863 | 9/1991 | LaBass et al. | 414/409 |
| 5,049,026 | 9/1991 | Bingman et al. | 414/408 |
| 5,064,332 | 11/1991 | Edelhoff et al. | 414/408 |
| 5,069,593 | 12/1991 | Zelinka et al. | 414/408 |
| 5,071,303 | 12/1991 | Carson | 414/408 X |
| 5,114,297 | 5/1992 | Kirchoff | 414/409 X |
| 5,114,304 | 5/1992 | Edelhoff et al. | 414/786 |
| 5,149,243 | 9/1992 | Naab et al. | 414/408 |
| 5,169,195 | 12/1992 | Kirchoff | 414/422 X |
| 5,215,423 | 6/1993 | Schulte-Hinsken et al. | 414/408 |
| 5,222,853 | 6/1993 | Carson | 414/408 |
| 5,222,854 | 6/1993 | Blatt et al. | 414/737 X |
| 5,252,020 | 10/1993 | Kinney et al. | 414/408 X |
| 5,275,522 | 1/1994 | Garrett, Jr. et al. | 414/407 |
| 5,308,211 | 5/1994 | Bayne | 414/408 |
| 5,324,161 | 6/1994 | Thobe | 414/406 X |
| 5,330,308 | 7/1994 | Armando et al. | 414/408 |
| 5,342,164 | 8/1994 | Kinney et al. | 414/408 X |
| 5,474,413 | 12/1995 | Georg | 414/408 |
| 5,513,937 | 5/1996 | Huntoon et al. | 414/408 |

TILTING BIN HANDLER

This application is a continuation of Ser. No. 08/411,494 filed Mar. 28, 1995, now abandoned.

BACKGROUND OF THE INVENTION

I. Field of the Invention

This invention relates generally to material handling equipment and, more particularly, to a container handler connected to a refuse truck for holding a refuse bin during collection efforts.

II. Discussion of the Related Art

Container handling equipment of the class of interest in relation to the present invention usually have a claw or flange for engaging a corresponding handle or rim connected to a container of interest. As described and shown in U.S. Pat. Nos. 4,844,682, issued to Edelhoff, and 5,033,930, to Kraus, the claw is connected to a handler base which, in turn, is connected to a supporting arm or a pair of supporting arms which are connected to a refuse vehicle and which pivot to lift the container during unloading operations. The claw engages the handle or rim from below and a locking member, which is pivotally attached to the base, is lowered to secure the container of interest between the claw and the locking member. As an alternative to the locking member, a suction cup may be provided attached to the base for holding the container during unloading operations as described and shown in U.S. Pat. No. 4,943,201, issued to Billon.

In a typical situation, the base may be lowered only to a position which is still a substantial distance above the ground. This makes it difficult to position the claw below a handle or rim on a container built low to the ground unless the claw is movable between a lowered and a raised position relative to the base.

U.S. Pat. Nos. 5,114,297 and 5,169,195, issued to Kirchhoff, describe such container handlers, i.e., wherein the claw may be lowered relative to a base. In one embodiment, a claw and locking member move along a vertical track operated by an hydraulic cylinder. The claw and locking member are positioned above a forklift which engages the container from below. Operation of this embodiment requires multiple actuators for adjusting the claw and the forklift and adapting it for mounting on a supporting arm would be difficult. In another embodiment, the handler base is held by chains. Pivoting arms are attached to the base and include a claw for engaging the container. The claw lacks a locking member or other device for holding the container in place and is not designed to be carried by a supporting arm.

OBJECTS

It is accordingly a principal object of the invention to provide an improved container handler.

Another object of the invention is to provide an improved container handler wherein the claw or engaging device moves between a lowered and a raised position relative to the handler base.

Yet another object of the invention is to provide a mechanically simplified container handler wherein the claw or engaging device moves between a lowered and a raised position relative to the base.

Still another object of the invention is to provide a container handler wherein the engaging device moves between the lowered and raised positions relative to a pivoting support arm which carries the base.

Still yet another object of the invention is to provide a container handler including a swivel mount which carries the engaging device and is pivotally attached to the base for pivoting between a lowered and a raised position.

A further object of the invention is to provide a container handler wherein a swivel mount is pivotally attached to the base for pivoting between the lowered and raised positions and the container is held between a flange on the base and a corresponding claw or flange on the swivel mount in the raised position.

A still further object of the invention is to provide a container handler wherein a swivel mount pivotally attached to the base carries a suction cup.

A yet still further object of the invention is to provide a container handler wherein a swivel mount is pivotally attached to the base and carries first and second handle engaging flanges wherein one handle engaging flange is movable between a retracted and a handle engaging position.

Other objects, features and advantages of the present invention will become apparent to those skilled in the art through familiarity with the summary of the invention, detailed description, claims, and drawings herein.

SUMMARY OF THE INVENTION

The foregoing objects of the present invention are among those attained by providing a container handler for a container unloading apparatus which may be used for dumping containers such as refuse bins into refuse receiving hoppers. Of course, the unloading apparatus may be used in any situation wherein containers are unloaded, including on stationary platforms and into refuse trucks. The handler is attached to a support structure or support arm which might be mounted anywhere and which tips the handler and the container during unloading operations. In a side loading refuse truck, for example, the handler may be pivotally attached to an articulated multiple member (compound) support arm attached to the side of the refuse truck. The handler includes a swivel assembly or mount pivotally attached to a handler base which is, in turn, connected to the support structure, such as the compound support arm. The swivel mount carries an engaging device for engaging the container of interest and holding the container during unloading operations.

The container or bin handler of the invention is described in detail in terms of three exemplary embodiments. One embodiment includes a hook device that grips a rim or handle on the container in combination with suction cups which attach to the side of the container. The other two embodiments include claws or flange devices that engage both upper and lower handles on the container of interest. In each embodiment, the swivel mount is able to pivot from the base between a lowered position and a raised position. Thus, the handler can adapt to engage rims and handles at various heights. The swivel mount is pivoted between the lowered and raised positions by an actuator, such as an hydraulic or pneumatic cylinder pivotally connected to the swivel mount and the base. The actuator may be operated in a conventional manner which is well known in the art.

In the rim gripping embodiment of the invention, container engaging fingers or a container engaging claw or flange is attached to the swivel mount and lowered into position below the rim or handle on the container. In the raised position, the swivel mount flange holds the rim against a corresponding flange attached to the base. Suction cups, which may be of the active venturi operated type, are attached to the swivel mount for engaging the side of the container. The suction cups may be activated and deactivated at any time during the unloading operation and in the example described herein, the suction cups are operated by a cam and switch situated in the support arm which activate the system with the container at about a 40° angle from vertical. This assures that the container is in contact with the suction cups when they are activated. Of course, the cam and switch or similar means could be situated in the base and swivel assembly and the suction cups could be activated and deactivated with the container held at a different angle.

In the handle engaging embodiments of the invention described herein, a handle engaging claw or flange is attached to the swivel mount and lowered below a first or upper handle on the container by pivoting the swivel mount. The flange is upward facing and engages the handle as the swivel mount is lifted to the raised position. A second flange is downward facing and pivotally attached to the swivel mount to pivot between a retracted and an engaging position. In the swivel mount lowered position, the second flange is retracted and during unloading operations the second flange is extended to engage a second or lower handle on the container and to hold the container for unloading. Two ways of deploying the second flange are described.

In one embodiment, a spring is attached to the second flange which is pivotally attached to the swivel mount. In the lowered position, the spring biases the second flange to the retracted position. In the raised position, a flange locking member, which is attached to the base, engages the second flange. This forces the second flange to extend and engage the second handle on the container of interest. In a second embodiment, an actuator, such as an hydraulic or pneumatic cylinder, is pivotally attached to the swivel mount and the second flange. Extending and retracting the actuator moves the second flange between the engaging and retracted positions. The actuator is operated during unloading operations by a cam and switch situated in the supporting arm with the container held at about a 40° angle.

The base of the handler may be mounted to any compatible lifting apparatus. For example, it may be attached to a material handling truck, such as a forklift, or an articulated mechanical support arm which is attached to a refuse truck, as it is in the preferred embodiment. In the latter situation, the mechanical support arm is manipulated to position the handler near the container of interest. The swivel mount is pivoted to engage the container and the arm is manipulated to lift and tip the container.

DETAILED DESCRIPTION

Figure 1A:
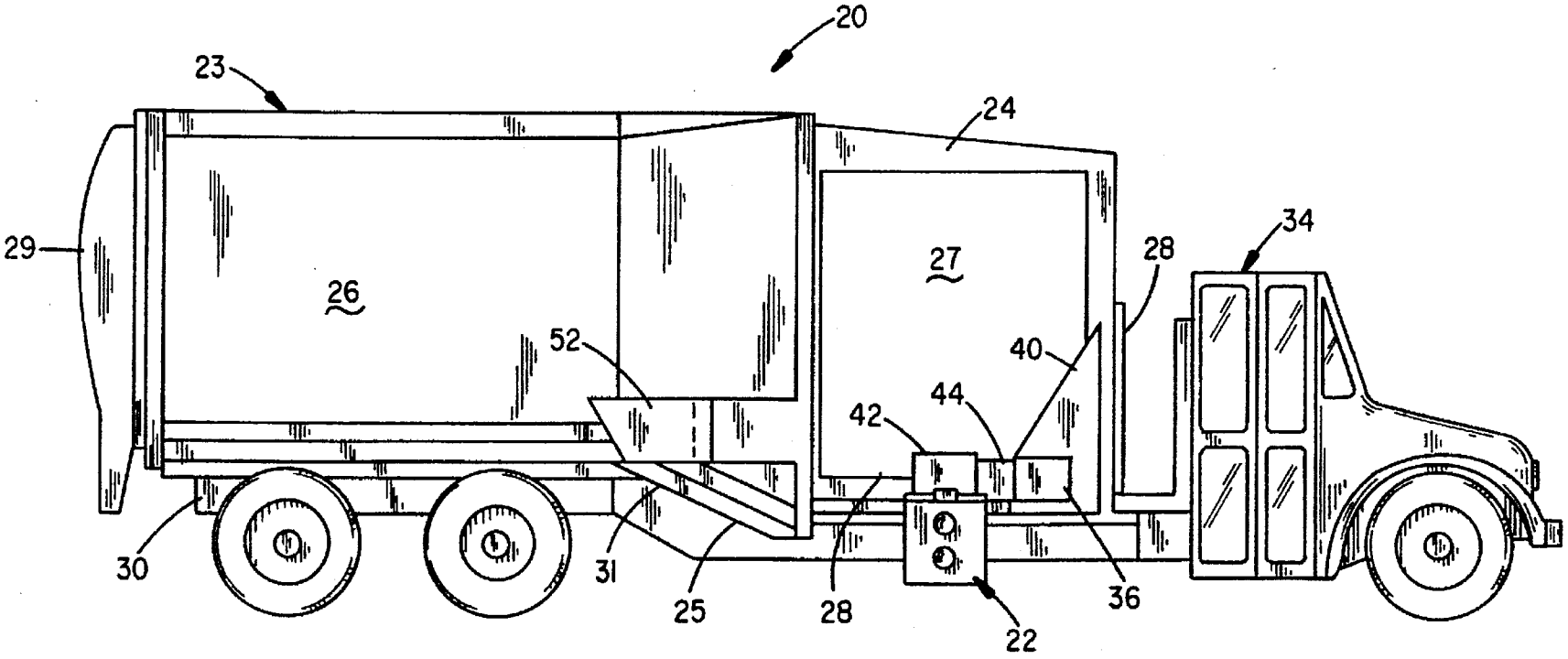
FIG. 1*a* is a side view of a side loading refuse truck showing a side loading refuse hopper equipped with a container handler in accordance with the present invention.
Figure 1B:
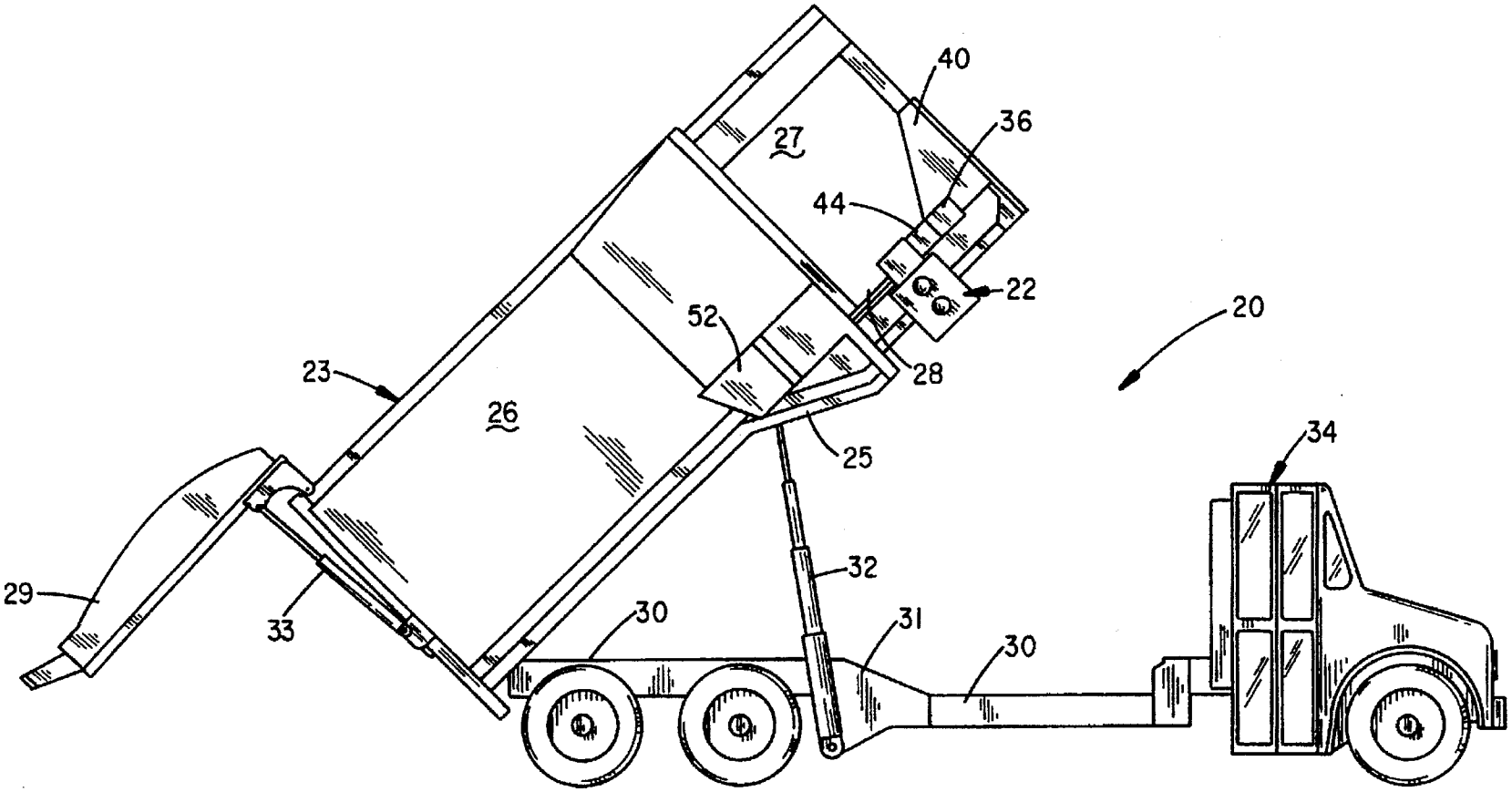
FIG. 1*b* is a view of a refuse truck similar to that of FIG. 1*a* with the truck body in the tilted position used for unloading the contents.

FIGS. 1*a* and 1*b* depict a side loading refuse truck generally at 20 which represents one of several types of such vehicles which may employ a container handler such as is shown retracted at 22 in accordance with the present invention. The truck 20 is shown with the truck body 23 in the lowered, refuse collecting orientation in FIG. 1*a* and with the body tilted up in the discharge position in FIG. 1*b*. The illustrated truck body 23 is of a "dropped bottom" variety to accommodate manual loading and includes a side loading refuse receiving hopper 24 having a lowered bottom and side opening attached by an intermediate ramped section 25 to a refuse holding or storage section 26. Refuse is loaded into openings 27 on either side of the receiving hopper and thereafter pushed rearward as by a conventional hydraulic cylinder operated compactor or packing ram (not shown) from hopper bin 28 into the holding or storage body 26 where it is packed against a heavy tailgate 29 as is well known.

The truck body 23 is carried by a truck frame or chassis 30 which is also provided with a sloped supporting section 31 matching body transition 25. The truck body is mounted behind a cab section 34 situated at the front of the vehicle 20. The truck body 23 may be of a unitary construction in which the receiving hopper and the storage volume are formed together as a single continuous unit. The body 23 may be pivotally attached to the truck chassis or frame 30 so that collected refuse may be discharged by opening the tailgate 29 and tilting the body 23 using a pair of telescoping cylinders, one of which is shown at 32 (FIG. 1*b*). The tailgate is typically operated by a pair of cylinders as at 33.

The container handler 22 may be mounted on the hopper as shown in the Figures or optionally mounted on the truck frame or chassis. The truck body illustrated is a side loading vehicle with a tipping unibody, but it should be appreciated that the mechanism 22 can also be used with a vehicle in which the storage body separates from the hopper and may be exchangeable. In other words, the vehicles pictured are meant to be illustrative only and by no means limiting as to the container handler 22 as it may also be used in any situation where a gripper of the class is needed, including, for example, on stationary platforms and front and rear loading refuse trucks.

Figure 2:
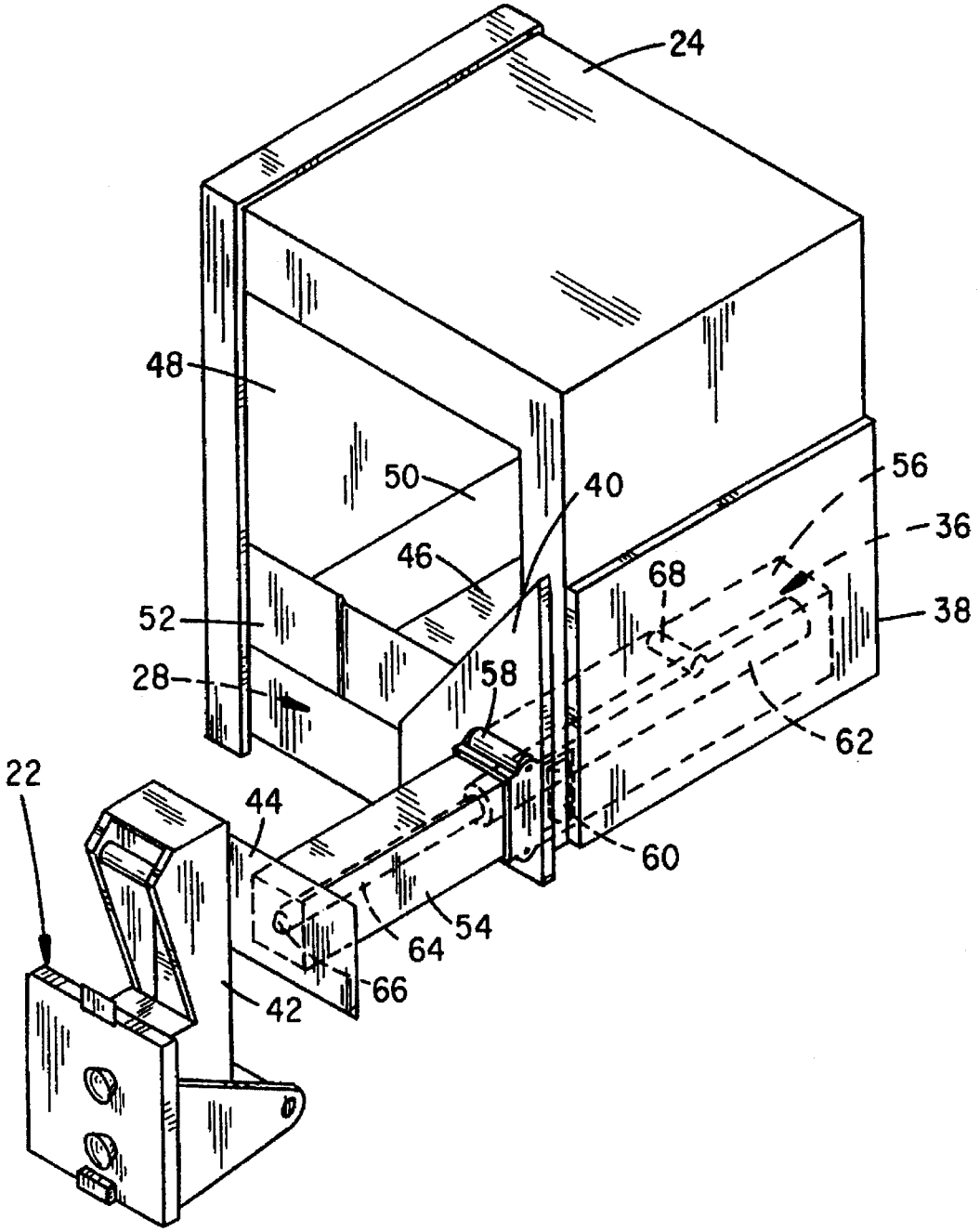
FIG. 2 is a fragmentary perspective view of the refuse hopper of FIG. 1 showing the container handler connected to a support arm which is attached to a partially extended telescoping boom arm.

As shown in FIGS. 1*a*, 1*b* and 2, an extendable telescoping boom arm, indicated generally by the reference numeral 36, is attached to the front of the refuse hopper 24 inside a rectangular frame 38 and in the front of the hopper bin 28 and a front wall 40. The container handler 22 is attached to a lifting support arm 42 which is itself attached to an arm mount 44 which is, in turn, securely attached to the boom arm 36. As illustrated, the arm mount 44 offsets the support arm 42 and handler 22 from the boom arm 36 to target the center of the refuse hopper 24.

The refuse hopper 24 shown in FIGS. 1*a*, 1*b* and 2 is of the type which includes a rectangular hopper bin 28 having an hydraulically operated rectangular compactor (not shown) which slides from the front to the rear of the bin 28. An hydraulically operated rectangular plate (not shown) is pivotally attached at the edge of the bin 28 near the slanted front wall 40. The plate is pivoted to a horizontal position to hold refuse in the bin 28 between the plate and hopper floor 46 during compacting operations. The refuse hopper 24 includes a back wall 48 which contains an opening in the form of a rectangular access 50. The compactor or packer pushes refuse through the access 50 into the intermediate and rear holding bodies 26 and 30.

The refuse hopper 24 is provided with a sliding or telescoping door 52 which is also attached to the hopper 24 to operate between an open position, FIG. 1*a* and 1*b*, and a closed position, FIG. 2. In the closed position, the door 52 prevents refuse from spilling out of the hopper 24 and onto the ground as a refuse container or bin is unloaded using the handler 22. In the open position, refuse can be easily manually thrown into the relatively lowered access hopper bin of the drop bottom hopper. The refuse hopper 24 and compactor are of a conventional rectangular variety. However, they can be any desired shape. One alternative shape is that of a semicircle which uses a pivoting reciprocating compacting arm that sweeps from side to side and pushes refuse through slots on either side of the pivoting arm and into a holding body.

Figure 3:
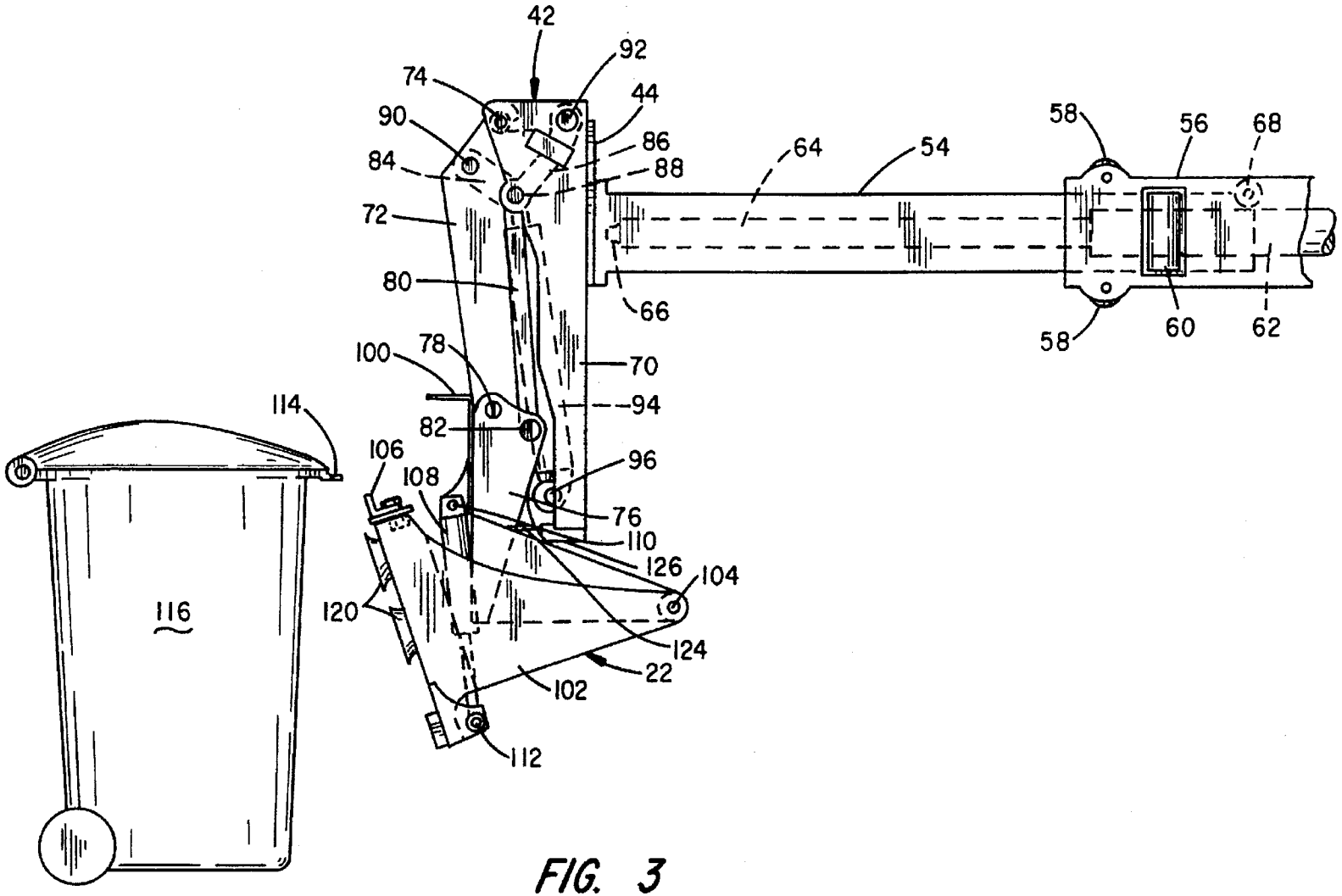
FIG. 3 is an enlarged view from the front of the refuse truck of FIG. 1 showing one embodiment of the container handler in a lowered position about to address a refuse container wherein attachment to the support arm and the substantially extended boom arm are also shown.

As shown in FIGS. 2 and 3, the boom arm 36 includes an inner telescoping boom arm 54 slidably disposed in an outer boom arm 56. Guide rollers 58 and 60 are connected in a conventional manner to the outer arm 56 for guiding the inner arm 54 in and out. An hydraulic cylinder 62 is connected to the outer arm 56 and has a cylinder rod 64 connected to a post 66 attached to the protruding end of the inner arm 54 such that extending and retracting the cylinder 62 moves the inner arm 54 correspondingly between an extended and a retracted position in a well-known manner. A slide roller 68 is rotatably attached to the inner arm 54 to facilitate moving the arm 54. The arm mount 44 attaches the inner arm 54 to the support arm 42 which, in turn, carries the container handler 22.

Figure 4:
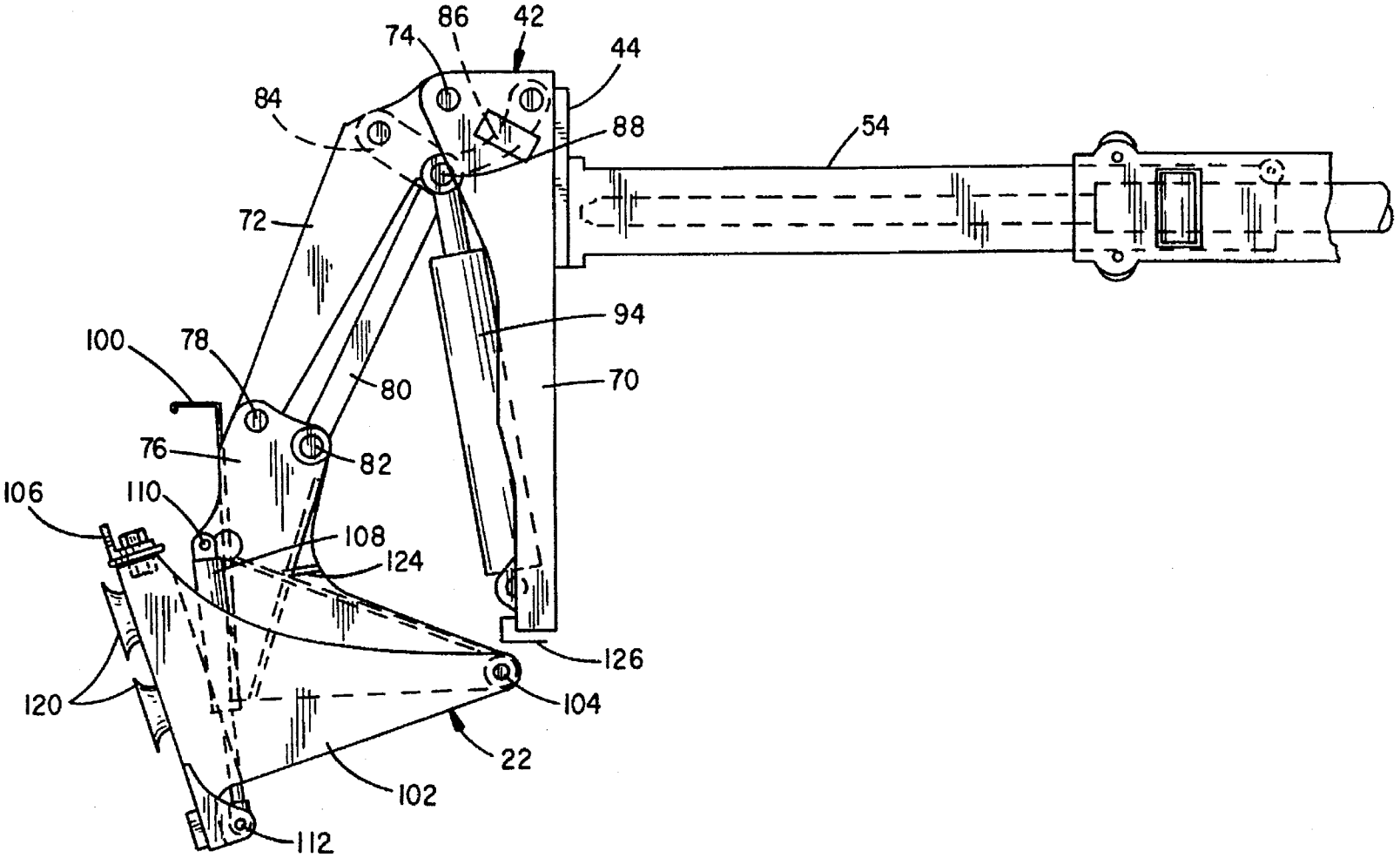
FIG. 4 is an enlarged front view of the embodiment of FIG. 3 showing the support arm partially extended.
Figure 6:
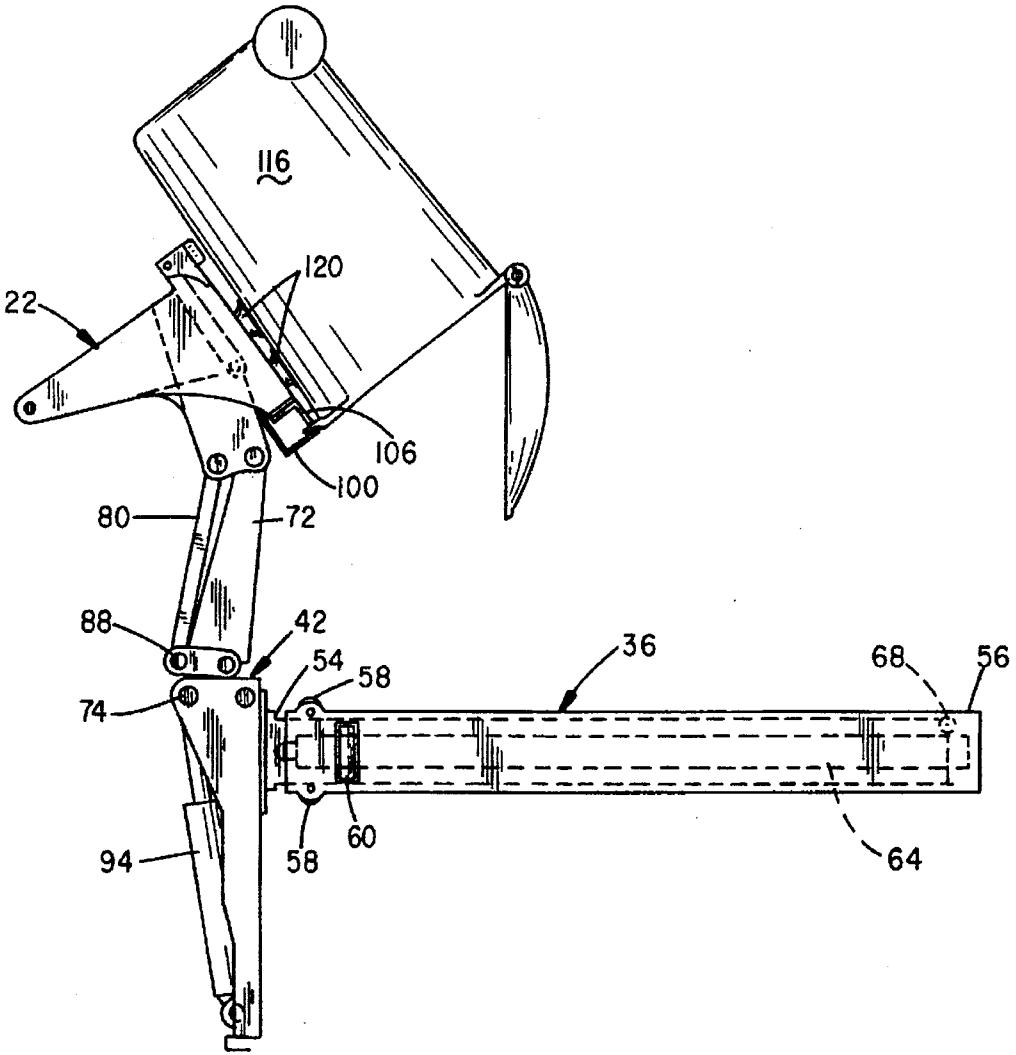
FIG. 6 is a reduced view of the embodiment of FIG. 3 showing the support arm in a fully extended position and the extendable boom arm in a fully retracted position with the container fully tipped for unloading.

As shown in FIGS. 3 and 4, the support arm 42 may be either fully retracted or partially extended for the system to engage a container of interest 116. The support arm 42 includes a support arm base member 70 attached to the arm mount 44. A lifting arm 72 having two opposing sides is pivotally attached at each side to the base member 70 such as at hinged pivot joint 74. This leaves a space between the sides of the lifting arm 72 at the central axis of the pivot joint 74. The sides of the lifting arm 72 are connected together and pivotally attached to a handler base 76 at hinged pivot joint 78. Linkage bar 80 is pivotally attached to the handler base 76 at 82 and to first and second arm bars 84 and 86 at 88. First arm bar 84 is pivotally attached to the lifting arm 72 at pivot joint 90 and second arm bar 86 is pivotally attached to the arm base 70 at pivot joint 92. An actuator 94, such as an hydraulic cylinder, is pivotally attached between the arm base 70 at 96 and pivot joint 88 such that extending the cylinder 94 pivots the lifting arm 72 about joint 74. The first arm bar 84 provides the needed leverage to pivot the lifting arm 72 about joint 74. As described above, the sides of lifting arm 72 are spaced at joint 74 which allows the cylinder rod of cylinder 94 to extend through the axis of joint 74 to raise the lifting arm 72 and linkage bar 80 to the unloading position, (FIG. 6). Of course, the arm base 70 remains stationary during this operation.

Figure 5:
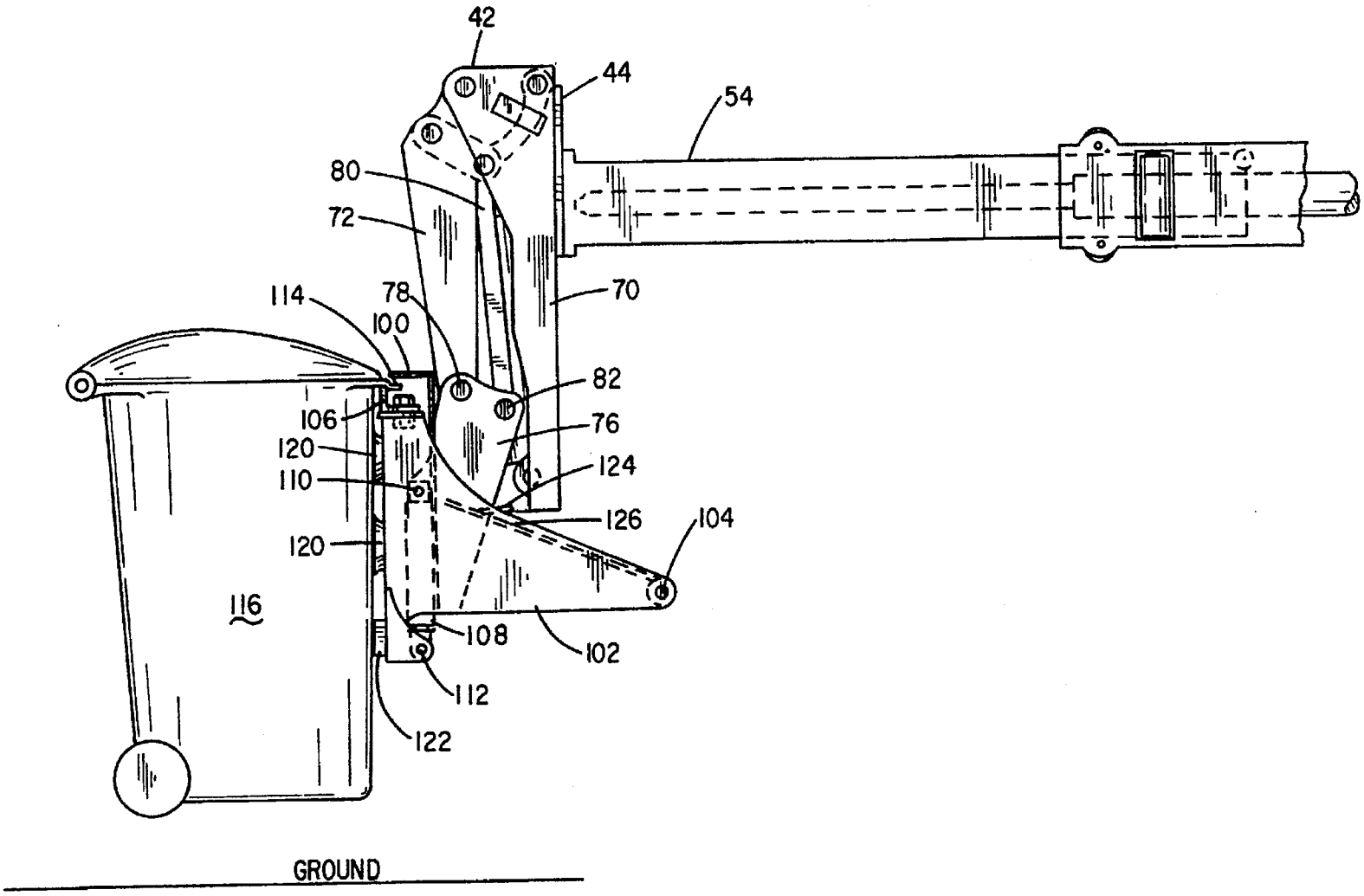
FIG. 5 shows the embodiment of FIG. 3 in the raised position engaging the container.

As shown in FIGS. 3–5, in one embodiment of the container handler 22, an upper gripping plate or flange 100 is securely attached to the handler base member 76 and a lower container engaging claw or flange 106 is pivotally attached on a vertical axis to a swivel mount 102. The swivel mount 102 is pivotally attached to the handler base 76 at hinged pivot joint 104. An actuator 108, preferably an hydraulic cylinder, is pivotally attached to the handler base 76 at 110 and to the swivel mount 102 at 112. Extending or retracting the actuator 108 pivots the swivel mount 102 between a lowered and a raised position, respectively. In one successful embodiment, the lower flange 106 can be lowered a distance up to eight inches (20 centimeters) below the upper flange 100.

To unload the container as at 116 the lower flange 106 is positioned below a handle or rim 114 on the container 116 and the cylinder 108 is retracted to lift the container 116 from the ground. As shown in FIG. 5, the handle or rim 114 is trapped (snared) and held between the lower flange 106 and the upper flange 100. The container 116 settles against a pair of active suction cups 120 and a bumper 122 attached to the swivel mount 102. With the support arm retracted, a bumper stop 124 which is securely attached to the handler base 76 rests against a support arm bumper 126 attached to the arm base 70.

As shown in FIG. 6, the container 116 is held by the container handler 22 as the support arm 42 raises and tilts the container 116 during unloading operations. Arm 54 is retracted to draw the container 116 inward toward the refuse hopper 24 and position the handler 22 for unloading. Lifting arm cylinder 94 is extended to pivot the lifting arm 72 about pivot joint 74 by pushing joint 88 through and above joint 74. This raises the lifting arm 72 and the linkage bar 80 to an essentially vertical, overhead position.

Figure 7:
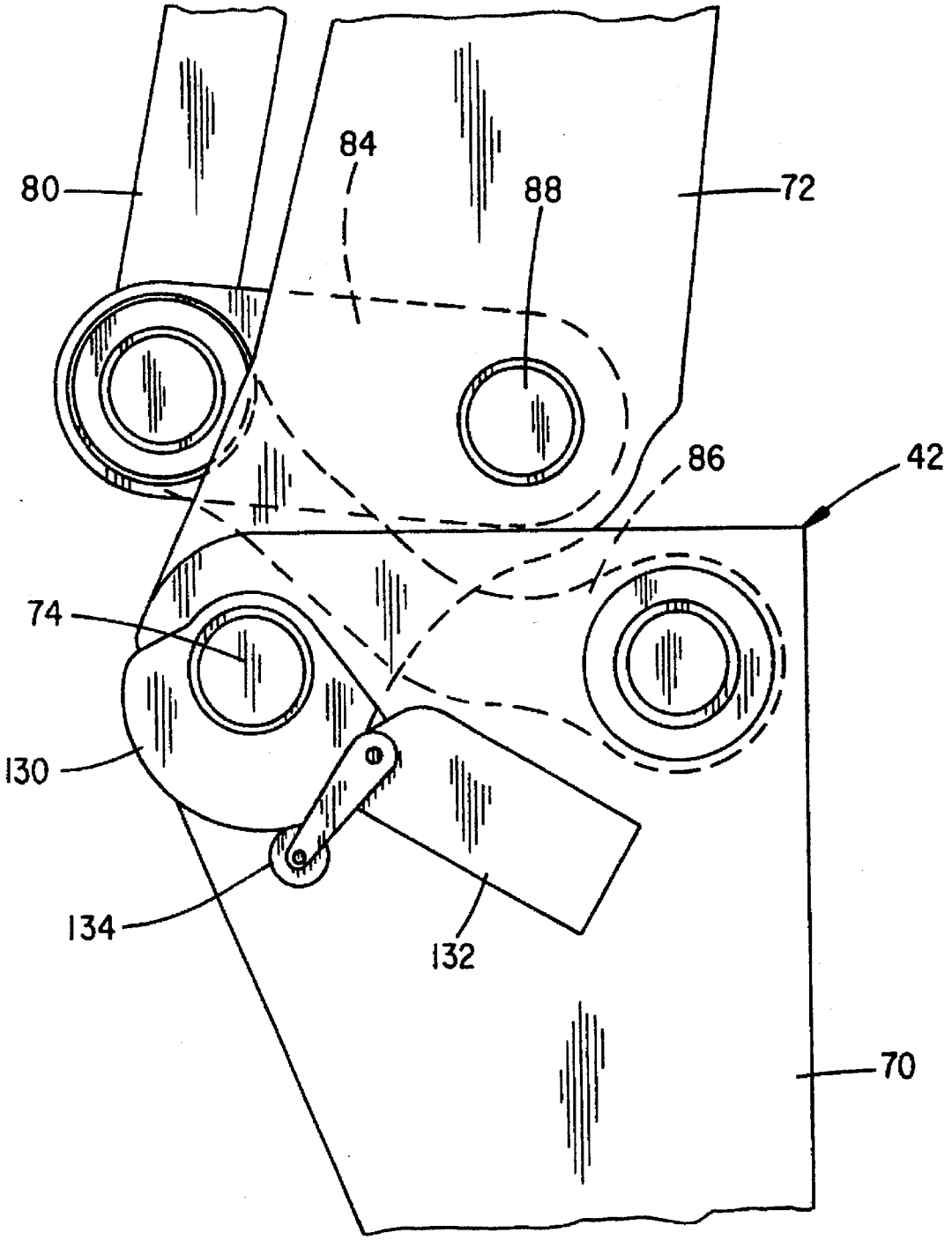
FIG. 7 is a magnified fragmentary view of one joint of the support arm of FIG. 6 showing the cam and switch arrangement.

The suction cups 120 are preferably air operated venturi type, active suction cups activated as by a cam 130 and switch 132 (FIG. 7) situated in the support arm 42. The cam 130 is attached to the pivot joint 74 such that the cam 130 rotates with the lifting arm 72 as the cylinder 94 is extended and retracted. The cam 130 contacts switch follower 134 which activates the switch 132 which, in turn, activates an air line (not shown) for operating the venturi type suction cups 120. When lifting arm 72 is raised above a predetermined angle, the cam 130 activates suction cups 120. In the preferred embodiment, this predetermined angle of lifting arm 72 is about 40° from vertical. Thus, the container 116 is held by the lower and upper flanges 106 and 100 and the suction cups 120 as the container 116 is tipped for unloading. The suction cups 120 remain activated until the lifting arm 72 again passes the 40° angle as the cylinder 94 is retracted to return the container 116 to an upright resting position. To complete the unloading operation, the actuator 108 is extended and the container 116 swings away from the handler 22 to engage the ground. The lower flange 106 is lowered below the rim 114 and the container 116 is left in the resting position.

Figure 8:
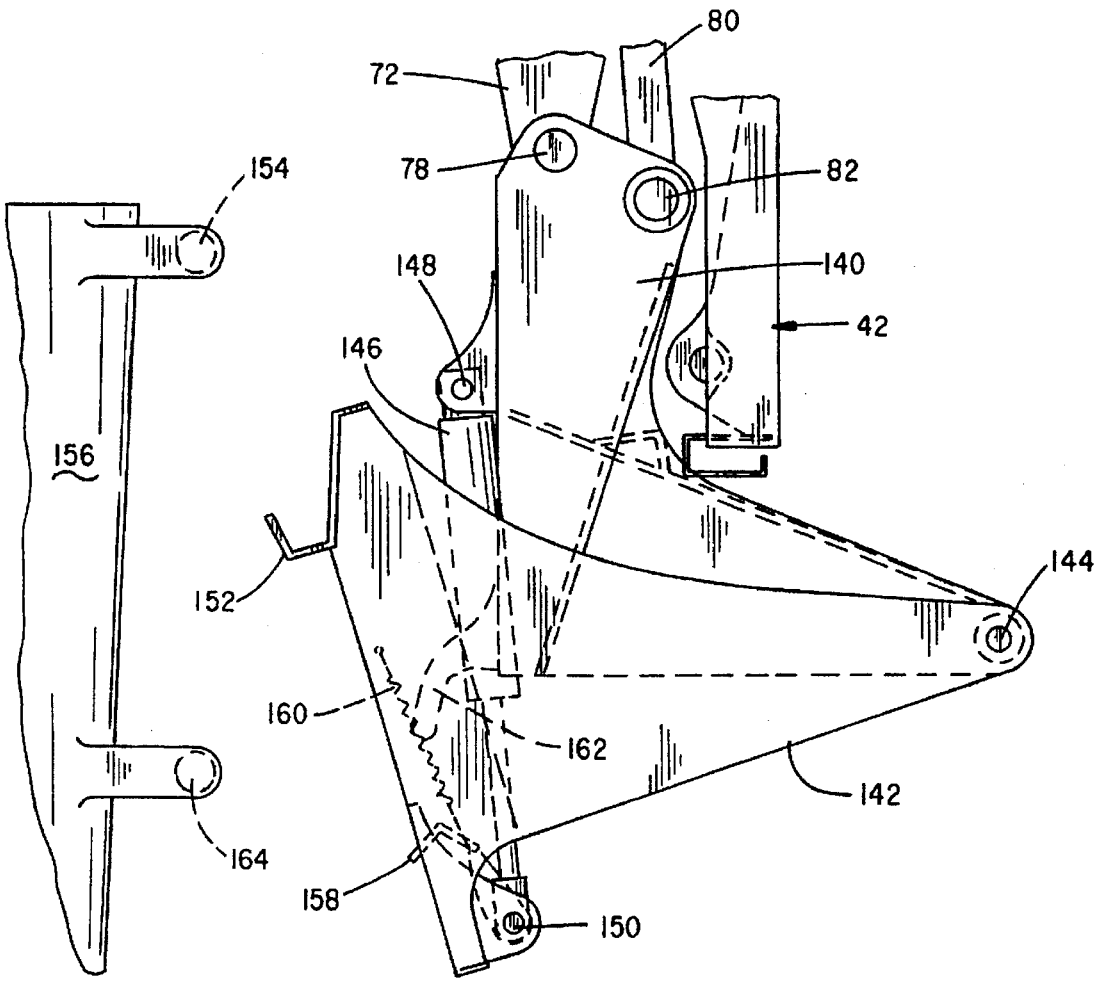
FIG. 8 is a greatly enlarged fragmentary view from the front of the truck of a handle holding embodiment of the container handler in the lowered position, pivotally attached to the support arm and showing the lower flange or claw in the retracted position.
Figure 9:
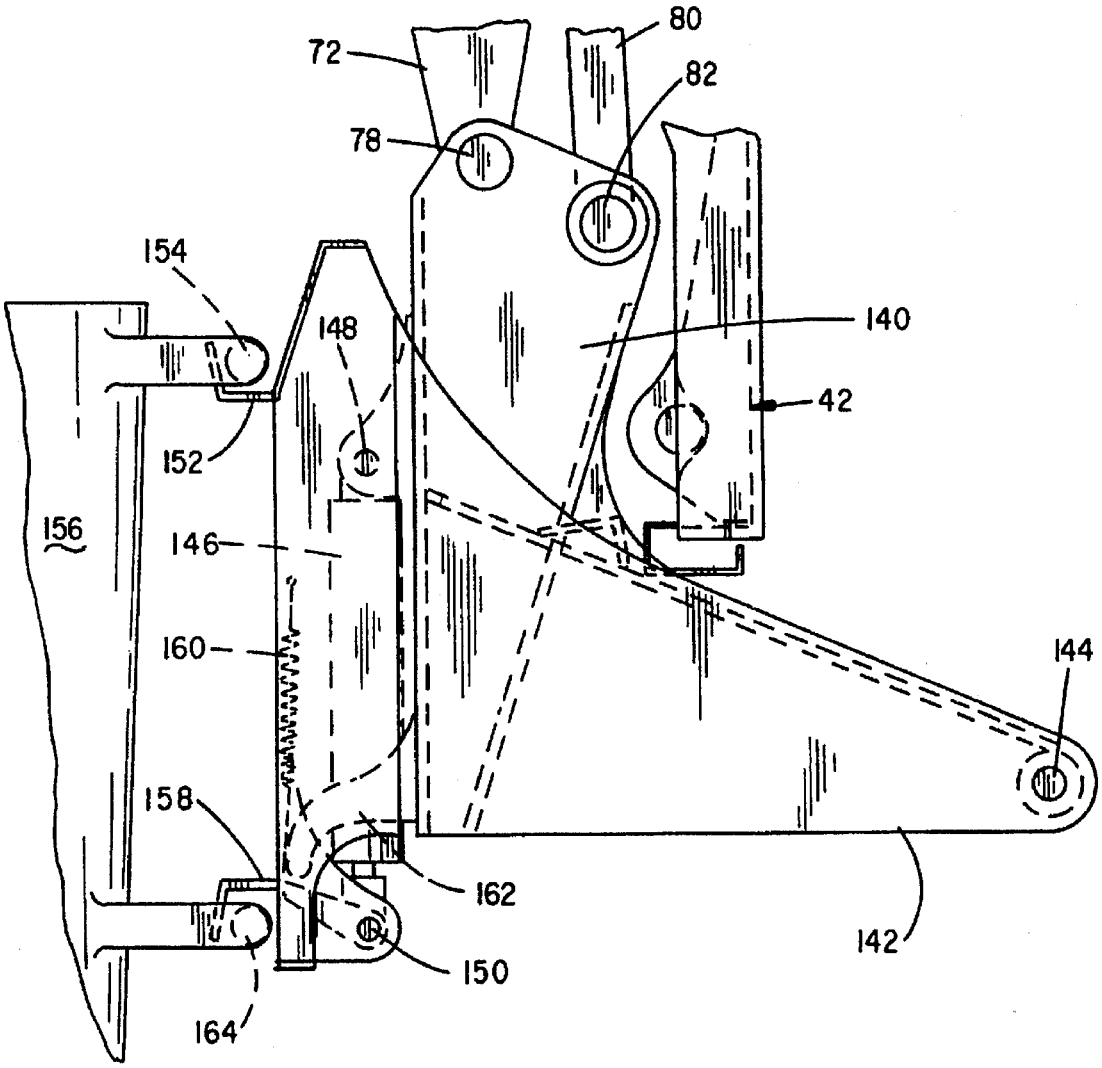
FIG. 9 is a slightly enlarged fragmentary front view of the handle holding embodiment of FIG. 8 showing the swivel mount in the raised position and, the flange in the handle engaging position.

In another embodiment of the invention shown in FIGS. 8 and 9, a handler base 140 is pivotally attached to the lifting arm 72 and the linkage bar 80 at pivot joints 78 and 82. A swivel mount 142 is pivotally attached to the handler base 140 at hinged pivot joint 144 and an actuator 146 is pivotally connected to the base 140 at 148 and to the swivel mount 142 at 150. An upper handle engaging flange 152 is securely attached to the swivel mount 142 and faces upward to engage a handle 154 on a container 156. Extending the actuator 146 lowers the swivel mount 142 and upper flange 152 below the handle 154. In this position, retracting the actuator 146 enables the upper flange 152 to engage the handle 154 and lift the container 156. A lower handle engaging flange 158 is pivotally attached to the swivel mount 142 at pivot joint 150 and biased to a retracted position by a spring 160. As the actuator 146 is retracted to pivot the swivel mount 142 to a raised position, a flange locking member 162 which is securely attached to the base 140 engages the lower flange 158 to push the flange 158 to an extended position and engage a lower handle 164 on the container 156. The container 156 may then be lifted by the support arm 42 to the unloading position. The container 156 is returned to the resting position by extending the actuator 146. This disengages the flange locking member 162 from the lower flange 158 which is then biased to the retracted position by spring 160. With the lower handle 164 disengaged, the actuator 146 extends further to disengage the upper flange 152 from the upper handle 154 of the container 156.

Figure 10:
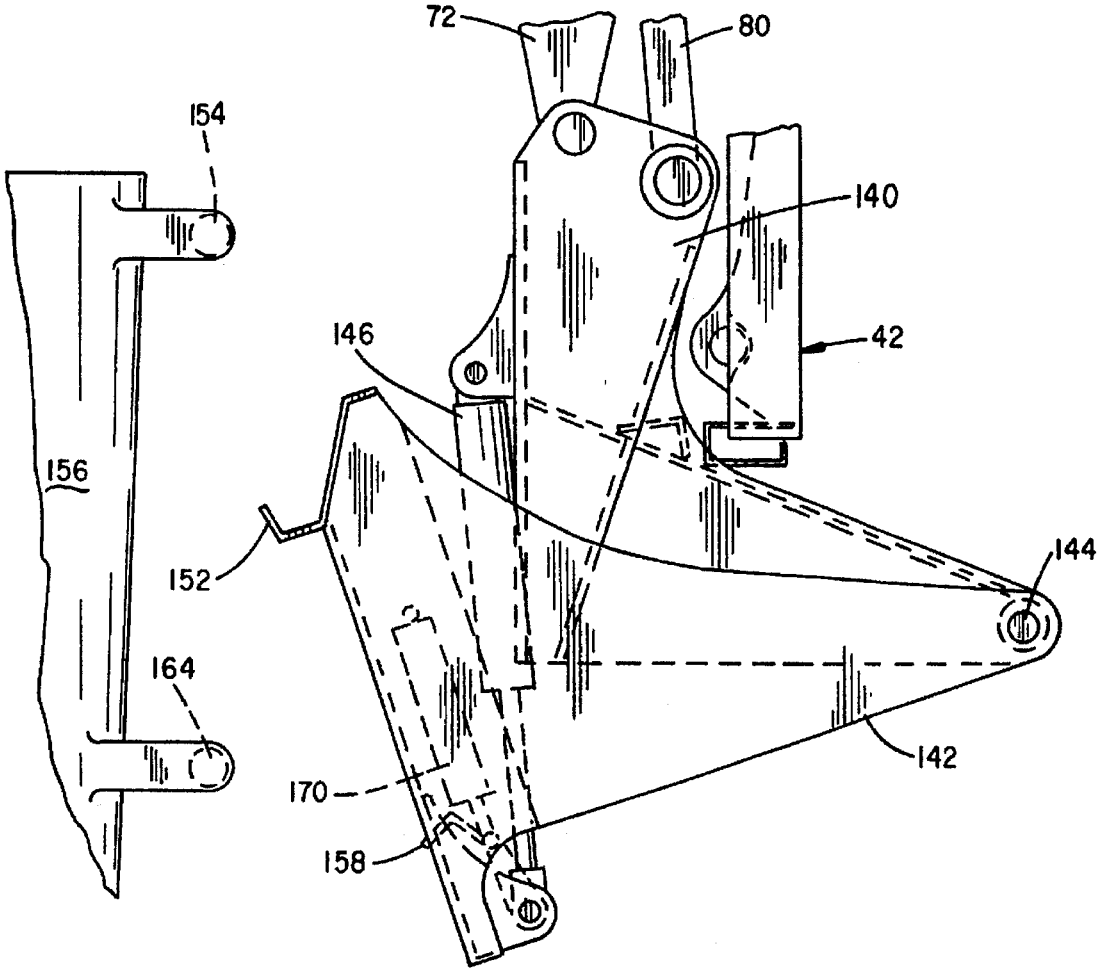
FIG. 10 is an enlarged fragmentary view from the front of the truck of a handle holding embodiment including a cylinder actuator for operating the lower flange shown in the retracted position.
Figure 11:
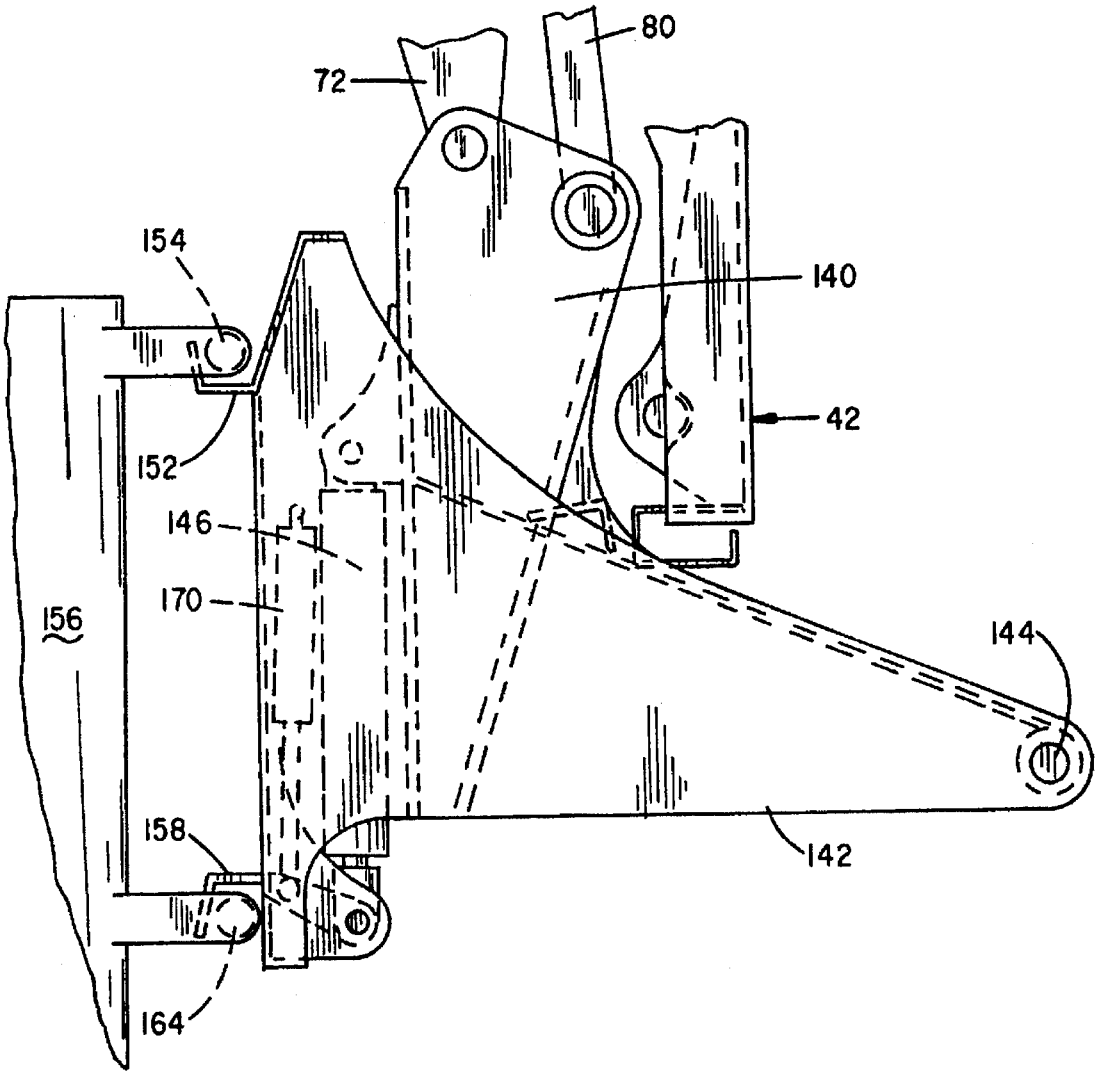
FIG. 11 is a slightly enlarged fragmentary view of the handle holding embodiment of FIG. 10 showing the actuator in the extended position and the lower flange in a handle engaging position.

In an alternative embodiment shown in FIGS. 10 and 11, the flange locking member 162 and the spring 160 are replaced by an actuator 170 pivotally attached to the swivel mount 142 and the lower flange 158. The actuator 170 is preferably air operated and may be activated by the cam 130 and switch 132 arrangement situated in the support arm 42, shown in FIG. 7. In operation, actuator 146 is extended to lower the swivel mount 142 and upper flange 152 below the handle 154 of the container 156. The upper flange 152 engages the handle 154 and lifts the container 156 from the ground as the actuator 146 is retracted. The cam 130 activates the switch 132 which, in turn, activates the actuator 170 as the lifting arm 72 pivots to unload the container 156. Extension of actuator 170 pivots the lower flange 158 which engages the lower handle 164. This position is maintained by the cam 130 and switch 132 until the lifting arm 72 is lowered past the point where the cam 130 contacts the cam follower 134. At this point, the actuator 170 retracts to disengage the lower flange 158 from the lower handle 164. The swivel mount actuator 146 is extended to lower the upper flange 152 below the upper handle 154 of the container 156 and return the container 156 to an upright resting position.

Figure 12:
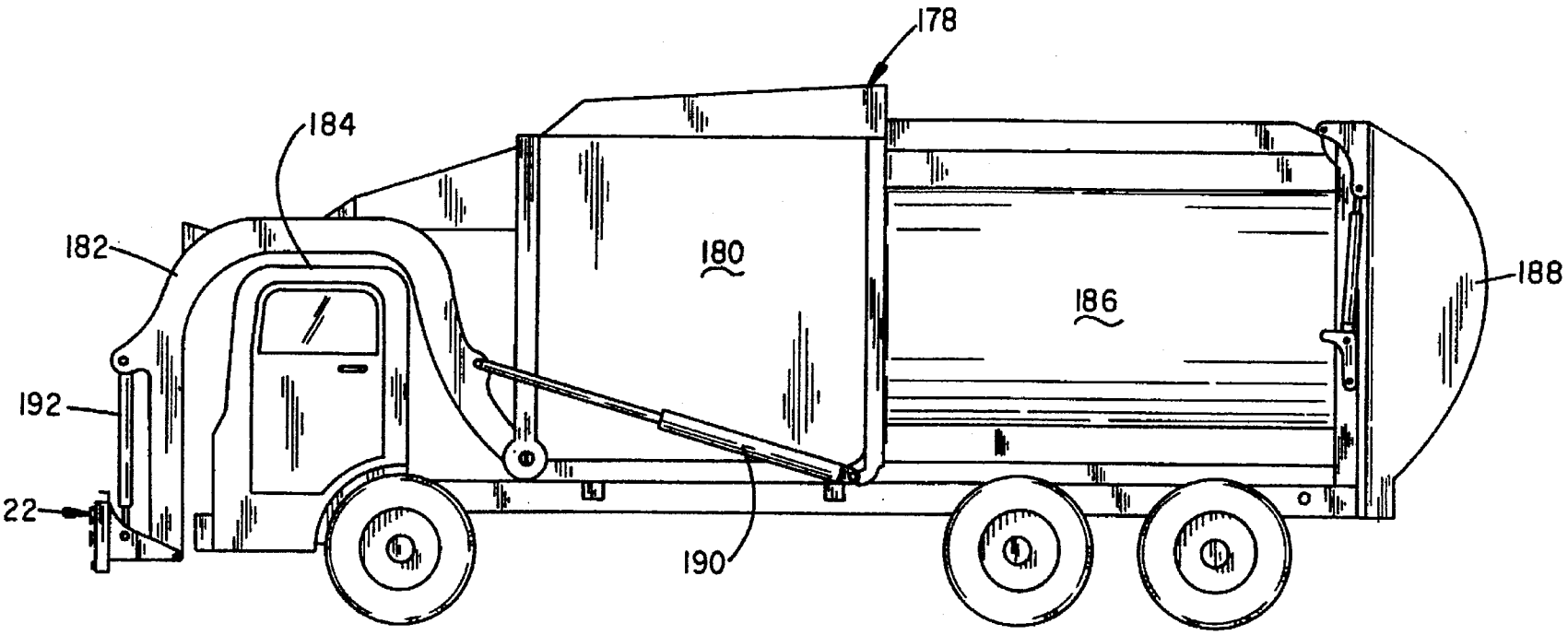
FIG. 12 is a side view of a front loading refuse truck showing a container handler of the invention attached to a lifting arm at the front of the truck.
Figure 13:
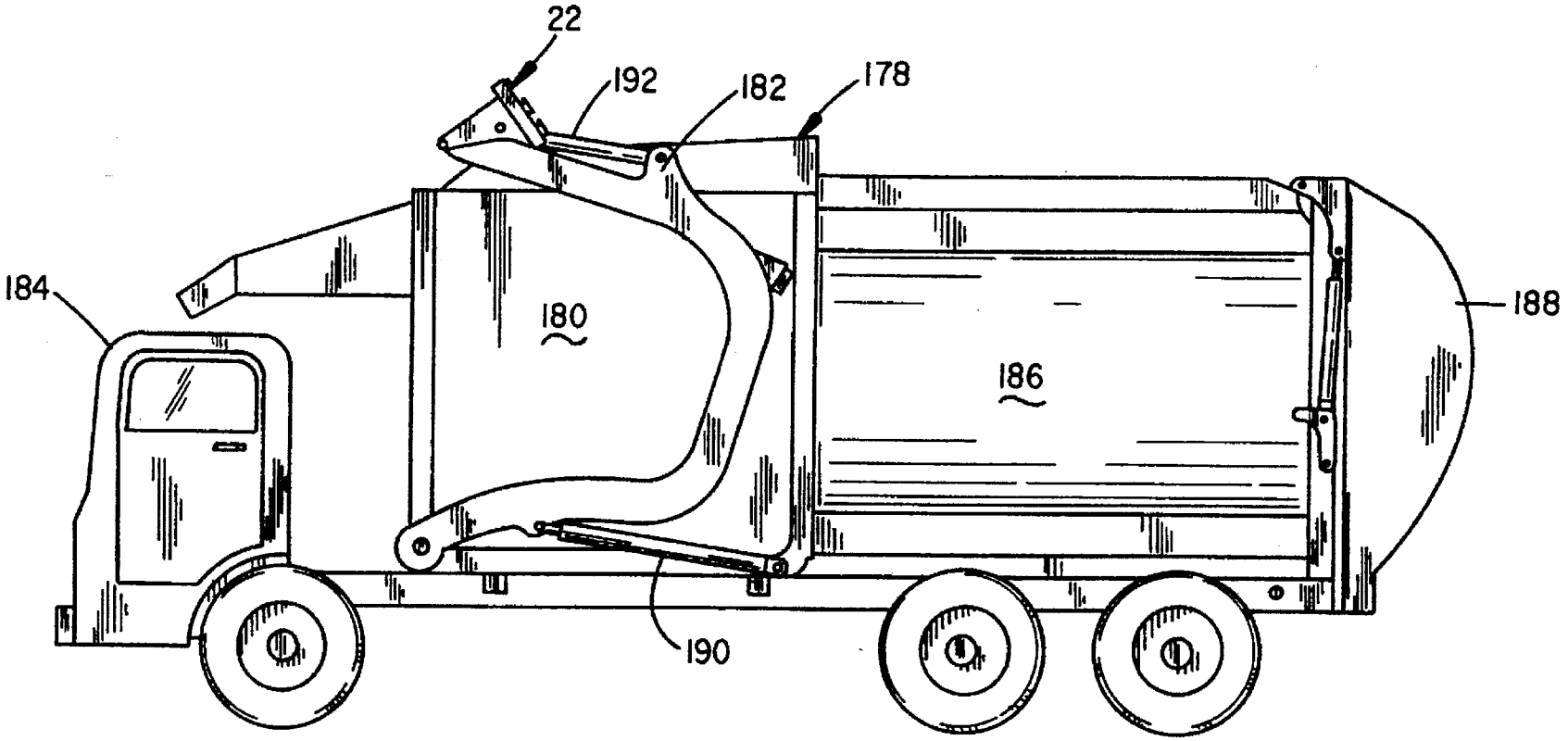
FIG. 13 is a side view of the refuse truck of FIG. 12 showing the container handler in the dumping or unloading position.

As shown in FIGS. 12 and 13, the container handler 22 may be attached to a front loading refuse truck 178 including a front loading hopper 180 and lifting arms 182. The truck 178 is of the conventional variety having a cab section 184 positioned at the front and a rear refuse holding body 186 and tailgate 188. The lifting arms 182 are raised to an unloading position by retracting arm cylinders 190 positioned on each side of the truck 178. A container unloading cylinder 192 which is pivotally attached to the handler assembly 22 is retracted to further tilt a container of interest for unloading. In operation, either one or two containers maybe lifted. Of course, the system may be incorporated wherever bins of the class need to be tipped and power is available.

This invention has been described herein in considerable detail in order to comply with the Patent Statutes and to provide these skilled in the art with the information needed to apply the novel principles and to construct and use such specialized components as are required. However, it is to be understood that the invention could be carried out by specifically different equipment and devices, and that various modifications, both as to the equipment details and operating procedures, can be accomplished without departing from the scope of the invention itself.

What is claimed is:

1. A vehicle mounted container handling apparatus, comprising:

(a) an extensible boom connected to said vehicle and having a free end carrying a platform;

(b) a support arm pivotally attached to said platform;

(c) a base fixed to said support arm;

(d) a swivel mount pivotally attached to said base for pivoting in a vertical plane relative to said base and said support arm;

(e) actuator means attached to said swivel mount for pivoting said swivel mount;

(f) a first flange carried by and fixed to said swivel mount;

(g) a second flange carried by said swivel mount; and (h) wherein said second flange is pivotally attached to said swivel mount and pivots between a retracted and an engaging position and pivoted by a device selected from the group consisting of a flange locking member secured to said handler base and an air operated actuator.

2. In a container grabbing and unloading apparatus including a pivoting support arm, a container grabbing means comprising:

(a) a handler base connected to the pivoting support arm;

(b) a swivel mount carrying a container engaging means pivotally attached to said handler base and adapted to pivot in a vertical plane to tilt and thereby raise and lower said container engaging means;

(c) container clamping means having a pair of opposed flanges, one carried by said container engaging means and one carried by said handler base comprising a first flange attached to said container engaging means and a second flange attached to said handler base, the height of said first flange being adjustable for engaging and capturing a handling protrusion on a container of interest and further adjustable for clamping said handling protrusion between said first and said second flanges; and (d) actuator means connected to said swivel mount for pivoting said swivel mount to tilt said container engaging means to adjust the position and height of the said first flange.

3. The container handler of claim 2 wherein said pair of flanges are caused to converge and diverge by the pivoting of said swivel mount.

4. The container handler of claim 3 wherein said handling protrusion is selected from the group including upper lips and handles.

5. The container handler of claim 4 including at least one active, air operated suction cup.

6. The container handler of claim 2 including a telescoping boom means for carrying said pivoting support arm.

7. The container handler of claim 2 including at least one active, air operated suction cup attached to said container engaging means.

8. A vehicle mounted container handling apparatus comprising:

(a) an extensible boom attached to a vehicle and having a free end carrying a platform;

(b) a support arm pivotally attached to said platform;

(c) a base connected to said support arm;

(d) a swivel mount carrying a container engaging means pivotally attached to said handler base and adapted to pivot in a vertical plane to tilt said container engaging means between a lowered and a raised position;

(e) actuator means connected to said swivel mount for pivoting said swivel mount to tilt said container engaging means to thereby adjust the position and height of said container engaging means; and (f) a container clamping means including a first moving flange carried by said swivel mount for engaging a handling protrusion of a container of interest a second flange carried by said base and stationary relative thereto, the operation of said swivel mount causing said first flange to engage and disengage said handling protrusion further to cause and said first and second flanges to open and close relative to each other about said handling protrusion.

9. A container handling apparatus comprising:

(a) a support arm pivotally attached to a platform and a handler base connected to said support arm;

(b) a swivel mount carrying a container clamping means pivotally attached to said handler base and adapted to pivot in a vertical plane to tilt a container engaging means adjustably between a lowered and a raised position;

(c) said container clamping means comprising a pair of opposed flanges carried by said swivel mount and oppositely disposed for engaging spaced parallel upper and lower handling protrusions attached to a container of interest, said pair including an upper flange attached to said swivel mount, said upper flange pivoting with said swivel mount thereby being height adjustable for engaging and capturing an upper handling protrusion on a container of interest at varying levels, and a lower flange pivotally attached to said swivel mount to pivot relative thereto between a retracted and a handle-engaging position to engage a lower handle;

(d) actuator means connected to said swivel mount for pivoting said swivel mount to tilt said container engaging means to adjust the height of the said first flange; and (e) lower flange pivoting means for pivoting said lower flange, said pivoting means being selected from the group consisting of a fixed flange locking member secured to said handler base and a fluid-operated linear actuator, said lower flange pivoting means being operable for fully securing said container to said swivel mount prior to the lifting of said container and throughout a lift and dump cycle.

10. The apparatus of claim 9 including a telescoping boom means for carrying said pivoting support arm.

11. The apparatus of claim 9 wherein said lower flange pivoting member is an air-operated cylinder.

* * * * *